US010902991B2

(12) United States Patent
Moon et al.

(10) Patent No.: US 10,902,991 B2
(45) Date of Patent: Jan. 26, 2021

(54) COIL COMPONENT

(71) Applicant: SAMSUNG ELECTRO-MECHANICS CO., LTD., Suwon-Si (KR)

(72) Inventors: Sung Min Moon, Suwon-Si (KR); Cheol Soon Kim, Suwon-Si (KR); Yu Jong Kim, Suwon-Si (KR); Dong Min Kim, Suwon-Si (KR); Young Do Choi, Suwon-Si (KR); Tae Ryung Hu, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 196 days.

(21) Appl. No.: 16/028,251

(22) Filed: Jul. 5, 2018

(65) Prior Publication Data

US 2019/0180915 A1 Jun. 13, 2019

(30) Foreign Application Priority Data

Dec. 11, 2017 (KR) ..... 10-2017-0169389

(51) Int. Cl.
*H01F 27/28* (2006.01)
*H01F 27/29* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC .... H01F 27/2804; H01F 27/29; H01F 27/327; H01F 27/292; H01F 27/324;
(Continued)

(56) References Cited

U.S. PATENT DOCUMENTS 6,246,541 B1 * 6/2001 Furuichi ..... G11B 5/3116 360/123.41
6,600,404 B1 7/2003 Kajino
(Continued)

FOREIGN PATENT DOCUMENTS

CN 104575937 A 4/2015
CN 106783069 A 5/2017
(Continued)

OTHER PUBLICATIONS

Office Action issued in Korean Application No. 10-2017-0169389 dated Apr. 19, 2019, with English translation.
(Continued)

*Primary Examiner* — Mang Tin Bik Lian
(74) *Attorney, Agent, or Firm* — Morgan, Lewis & Bockius LLP

(57) ABSTRACT

A coil component includes: a body including a support member including a through-hole, a first insulating layer disposed on the support member and including a first opening pattern, a second insulating layer disposed on the first insulating layer and including a second opening pattern, and a coil including a coil pattern filled in the first and second opening patterns; and external electrodes disposed on an outer surface of the body. The coil pattern has a stacking structure composed of a plurality of layers, and the plurality of layers includes a thin film conductor layer in contact with the support member, the thin film conductor layer extending to an entire lower surface of the first opening pattern and at least portions of side surfaces of the first opening pattern.

20 Claims, 3 Drawing Sheets

(51) Int. Cl.
*H01F 41/24* (2006.01)
*H01F 27/32* (2006.01)
*H01F 17/04* (2006.01)
*H01F 17/00* (2006.01)

(52) U.S. Cl.
CPC ..... *H01F 27/29* (2013.01); *H01F 27/292* (2013.01); *H01F 27/324* (2013.01); *H01F 27/327* (2013.01); *H01F 41/24* (2013.01); *H01F 2017/048* (2013.01); *H01F 2027/2809* (2013.01)

(58) Field of Classification Search
CPC ..... H01F 27/323; H01F 2027/2809; H01F 17/0013; H01F 17/04; H01F 17/048; H01F 2017/048; H01F 1/37; H01F 41/24
USPC ..... 336/200, 192, 223
See application file for complete search history.

(56) References Cited

U.S. PATENT DOCUMENTS

| | | | | |
|---|---|---|---|---|
| 7,221,250 | B2 * | 5/2007 | Yoshida | H01F 27/2804 336/200 |
| 10,199,154 | B2 | 2/2019 | Hong et al. | |
| 10,276,294 | B2 | 4/2019 | Kim et al. | |
| 2011/0310579 | A1 * | 12/2011 | Smeys | H01F 17/04 361/782 |
| 2015/0035634 | A1 * | 2/2015 | Nakamura | H01F 17/0013 336/170 |
| 2015/0035640 | A1 * | 2/2015 | Wang | H01F 17/0006 336/200 |
| 2015/0048918 | A1 * | 2/2015 | Park | H01F 17/0013 336/200 |
| 2015/0109088 | A1 | 4/2015 | Kim et al. | |
| 2015/0155556 | A1 * | 6/2015 | Kawakami | C01G 45/1228 252/182.1 |
| 2015/0255208 | A1 | 9/2015 | Kim et al. | |
| 2015/0294789 | A1 | 10/2015 | Sano et al. | |
| 2016/0078998 | A1 * | 3/2016 | Park | H01F 17/0013 336/105 |
| 2016/0086721 | A1 * | 3/2016 | Park | H01F 27/2804 336/200 |
| 2016/0351316 | A1 * | 12/2016 | Ohkubo | H01F 27/325 |
| 2017/0140866 | A1 | 5/2017 | Hong et al. | |
| 2017/0178789 | A1 | 6/2017 | Kim et al. | |
| 2017/0178790 | A1 | 6/2017 | Kim et al. | |
| 2017/0178798 | A1 | 6/2017 | Yoon et al. | |
| 2017/0330674 | A1 | 11/2017 | Lee et al. | |
| 2019/0180913 | A1 | 6/2019 | Moon et al. | |

FOREIGN PATENT DOCUMENTS

| | | | | |
|---|---|---|---|---|
| CN | 106898479 | A | | 6/2017 |
| CN | 107369536 | A | | 11/2017 |
| JP | 2017-017139 | A | * | 1/2017 |
| KR | 10-1999-0066108 | A | | 8/1999 |
| KR | 10-2015-0079935 | A | | 7/2015 |
| KR | 10-2015-0105787 | A | | 9/2015 |
| KR | 10-2017-0060296 | A | | 6/2017 |
| KR | 10-1762039 | B1 | | 7/2017 |

OTHER PUBLICATIONS

Office Action issued in corresponding Chinese Patent Application No. 201811244703.3 dated Oct. 12, 2020, with English translation.

* cited by examiner

COIL COMPONENT

CROSS-REFERENCE TO RELATED APPLICATION(S)

This application claims the benefit of priority to Korean Patent Application No. 10-2017-0169389, filed on Dec. 11, 2017 in the Korean Intellectual Property Office, the disclosure of which is incorporated herein by reference in its entirety.

BACKGROUND

1. Field

The present disclosure relates to a coil component, and more particularly, to a thin film type power inductor advantageous for high inductance and miniaturization.

2. Description of Related Art

In accordance with the development of information technology (IT), apparatuses have been rapidly miniaturized and thinned. Therefore, market demand for small, thin devices has increased.

Korean Patent Laid-Open Publication No. 10-1999-0066108 provides an a power inductor including a board having a via hole and coils disposed on both surfaces of the board and electrically connected to each other by the via hole of the board, in line with technical trends, thereby making an effort to provide an inductor including coils having a uniform and high aspect ratio.

SUMMARY

An aspect of the present disclosure may provide a coil component capable of simultaneously improving electrical characteristics such as Rdc characteristics, and the like, and reliability of a miniaturized inductor by allowing a coil pattern in the inductor to have a fine line width.

According to an aspect of the present disclosure, a coil component includes: a body including a support member including a through-hole, a first insulating layer disposed on the support member and including a first opening pattern, a second insulating layer disposed on the first insulating layer and including a second opening pattern, and a coil including a coil pattern filled in the first and second opening patterns; and external electrodes disposed on an outer surface of the body. The coil pattern may have a T-shaped cross section of which a line width of an upper surface is wider than that of a lower surface, and have a stacking structure composed of a plurality of layers. Further, among the plurality of layers of the coil pattern, a thin film conductor layer in contact with the support member may extend to an entire lower surface of the first opening pattern and at least portions of side surfaces of the first opening pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Hereinafter, a coil component according to an exemplary embodiment in the present disclosure will be described, but is not necessarily limited thereto.

Figure 1:
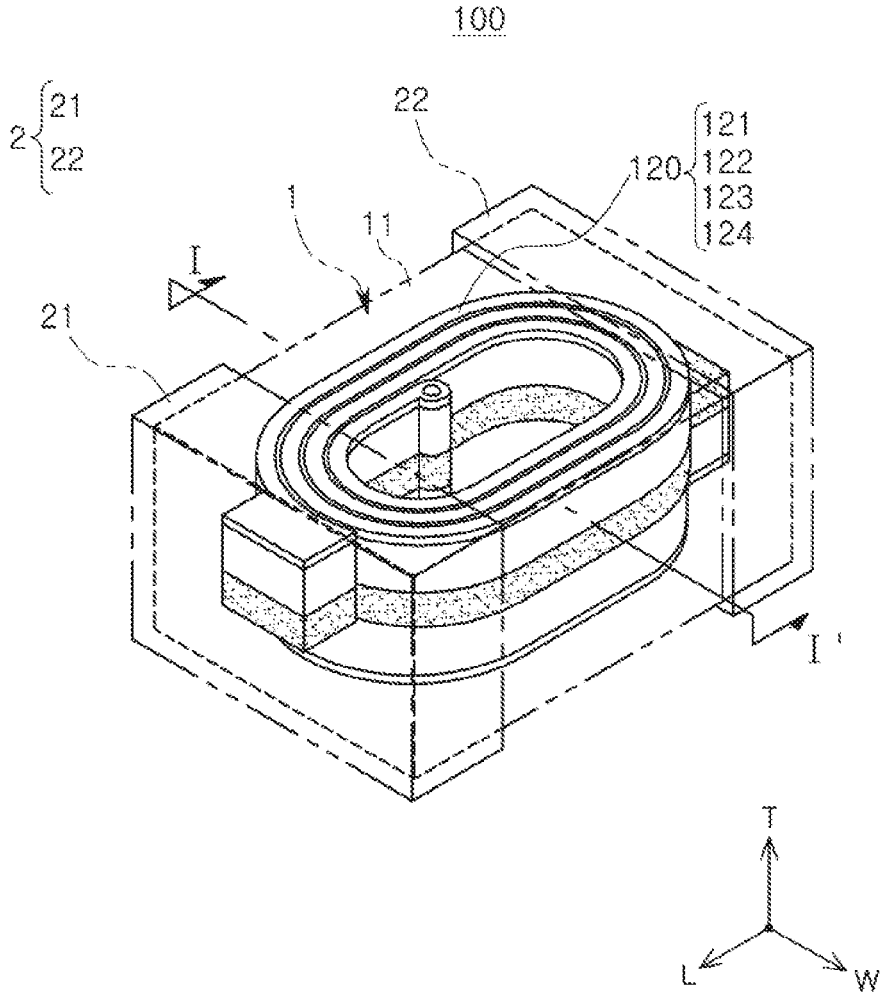
FIG. 1 is a perspective view of a coil component according to an exemplary embodiment in the present disclosure.
Figure 2:
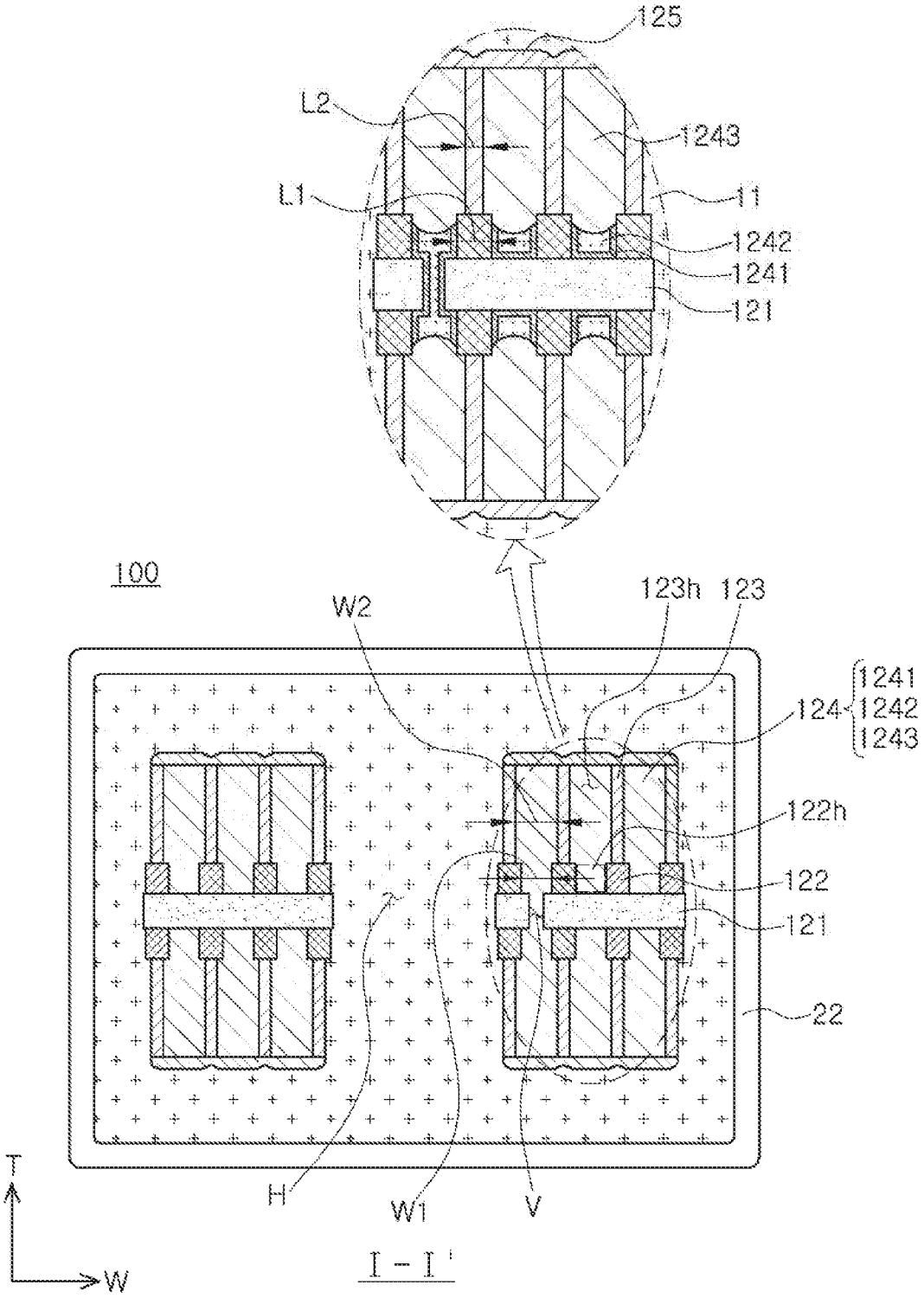
FIG. 2 is a cross-sectional view taken along line I-I' of FIG. 1.

FIG. 1 is a schematic perspective view of a coil component according to an exemplary embodiment in the present disclosure, and FIG. 2 is a cross-sectional view taken along line I-I' of FIG. 1.

Referring to FIGS. 1 and 2, a coil component 100 may include a body 1 and external electrodes 2. The external electrodes may include first and second external electrodes 21 and 22 having different polarities from each other.

The body 1 may form an exterior of an inductor, have upper and lower surfaces opposing each other in a thickness (T) direction, first and second end surfaces opposing each other in a length (L) direction, and first and second side surfaces opposing each other in a width (W) direction, and have a substantially hexahedral shape.

The body 1 may contain a magnetic material 11 having magnetic properties. The magnetic material may be suitably selected by those skilled in the art as needed. For example, the magnetic material may be ferrite or a metal-resin composite material in which metal magnetic particles are dispersed in a resin.

A coil part 120 of the coil component may be encapsulated by the magnetic material 11, and include a support member 121, first and second insulating layers 122 and 123 sequentially stacked on the support member, and a coil pattern 124.

The support member 121 may be an insulating board formed of an insulating resin. As the insulating resin, a thermosetting resin such as an epoxy resin, a thermoplastic resin such as polyimide, resins in which a reinforcement material, such as a glass fiber or an inorganic filler, is impregnated in the thermosetting resin and the thermoplastic resin, for example, a prepreg, an ajinomoto build-up film (ABF), FR-4, a bismaleimide triazine (BT) resin, a photo imageable dielectric (PID) resin, or the like, may be used. The support member may have a thin thickness so that a thickness of the coil pattern may be increased within a limited thickness of the coil component. For example, the thickness of the support member may be about 10 μm or more to less than 60 μm.

The support member may include a through-hole H and a via hole V in the vicinity of the through-hole, wherein the through-hole may be filled with the magnetic material, and the via hole may be filled with a conductive material. The reason is that the through-hole is a space serving to enhance a magnetic flux generated by the coil, and the via hole is a space serving to electrically connect upper and lower coil patterns on and below the support member to each other.

Next, a first insulating layer 122 may come in contact with one surface and the other surface of the support member and include an opening pattern **122*h*** partially exposing one surface or the other surface of the support member. Since the opening pattern may have a shape corresponding to an entire shape of the coil pattern, the opening pattern may have, for example, a spiral shape formed by winding circles with different radii of curvature from each other several times.

An angle between a side surface of the opening pattern 122*h* and one surface or the other surface of the support member may be suitably selected by those skilled in the art. Considering that the conductive material is filled in the opening pattern, a line width of the opening pattern may be decreased in a direction toward the support member.

As the support member becomes thinned, there is a risk that rigidity for supporting the coil pattern, and the like, supported on the support member will not be secured, and there is a problem in that it may become difficult to control the support member during a process. Therefore, the first insulating layer may be a configuration for solving these problems. Further, the first insulating layer may be a configuration for increasing a contact area between the support member and a second insulating layer to be described below, serving as a plating growth guide of a coil pattern to solve a problem such as leaning or delamination phenomenon of the second insulating layer.

Therefore, as a material of the first insulating layer, any material may be used without limitation as long as it has insulation properties and a suitable level of rigidity, but there is a need to form the opening pattern in the first insulating layer, a material having excellent processing properties as well as insulation properties may be preferably selected. For example, the first insulating layer may be formed of a PID resin or ABF film. In this case, in order to relatively increase the thickness of the coil pattern and a thickness of the magnetic material encapsulating the coil pattern within the entire thickness of the coil component, the first insulating layer may be formed to have a thin thickness, for example, about 5 μm or more to 20 μm or less, but is not limited thereto.

The second insulating layer 123 may be disposed on the first insulating layer. The second insulating layer 123 may include an opening pattern 123*h* at a position corresponding to the opening pattern 122*h* of the first insulating layer. In this case, a line width w1 of the opening pattern 122*h* of the first insulating layer may be narrower than a line width w2 of the opening pattern 123*h* of the second insulating layer. The reason is that since the first insulating layer serves to enhance adhesive force between the second insulating layer and the support member and to prevent voids from being generated in a lower edge of the coil pattern, but the second insulating layer serves as a guide at the time of plating growth of the coil pattern, there is a need to decrease a line width of the second insulating layer in order not to limit the number of turns of the coil pattern while including a thickness corresponding to the thickness of the coil pattern.

The second insulating layer 123 may be formed of a material which has insulation properties and on which patterning for opening pattern may be easily performed, and may contain a permanent type photosensitive insulating material. An insulating sheet containing a photosensitive insulating material for forming the second insulating layer may be laminated, and patterned so as to have the opening pattern 123*h* having a shape corresponding to the coil pattern using an exposure and development method.

The second insulating layer may be disposed on an approximately central portion of the first insulating layer, and since a line width of the first insulating layer is relatively wider than that of the second insulating layer, it may be relatively easy to arrange the second insulating layer on the first insulating layer.

A line width L1 of the first insulating layer may be in a range of about 15 μm or more to 100 μm or less. When the line width L1 is smaller than 15 μm, it may be difficult to adjust alignment of the second insulating layer on the first insulating layer, and when the line width L1 is more than 100 μm, there is a limitation in the number of turns of the coil pattern within a limited size range of the coil component, which is the same content as that a substantial seed layer needs to be filled between the first insulating layers, but there is a limitation in a space in which the seed layer may be filled.

Further, a line width L2 of the second insulating layer may be in a range of about 5 μm or more to 20 μm or less. There is a technical limitation in implementing a line width of less than 5 μm, and when the line width L2 is more than 20 μm, there is a limitation in allowing the first insulating layer to have a fine line width.

The second insulating layer may have a thickness within a range from 100 μm or more to 300 μm or less. The thickness is less than 100 μm, which is not suitable for the trend to implement a coil pattern having a high aspect ratio, and when the thickness is more than 300 μm, the coil pattern having a high aspect ratio may be implemented, but there is a risk that a process will be repeated plural times, such that process efficiency may be deteriorated.

Next, since the opening pattern 122*h* of the first insulating layer has a line width narrower than that of the opening pattern 123*h* of the second insulating layer as described above, the coil pattern 124 filled in the opening pattern of the first insulating layer and the opening pattern of the second insulating layer may have a T-shaped cross section of which a line width of a lower surface is narrower than that of an upper surface.

The coil pattern 124 may have a stacking structure composed of plurality of layers. All the plurality of layers included in the coil pattern may contain a conductive material. First, a lowermost layer of the coil pattern coming into contact with the support member may be a thin film conductor layer 1241. In this case, the thin film conductor layer may come in contact with at least a portion of a side surface of the first insulating layer and an entire lower surface of the opening pattern of the first insulating layer. A method of forming the thin film conductor layer 1241 is not limited, but for convenience of a process, a chemical copper plating method may be used. More specifically, a method of remaining only a shape of the thin film conductor layer using etching after preparing a support member on which a first insulating layer including the opening pattern is disposed and performing the chemical copper plating on an entire exposed surface of the support member may be adopted, but the method of forming the thin film conductor layer 1241 is not limited thereto.

Since the thin film conductor layer 1241 is continuously formed on the side surfaces of the first insulating layer opposing each other and the upper surface of the support member continuously connected thereto, there is no risk that a void of the coil pattern will be generated in edge portions formed by the first insulating layer and the support member. As a material of the thin film conductor layer, any material may be used as long as it has excellent electrical conductivity. For example, the thin film conductor layer may contain Cu.

Next, an exposed surface of the thin film conductor layer may be enclosed by a base layer 1242. Here, the exposed surface may mean a surface of the thin film conductor layer that does not come in contact with the first insulating layer or the support member. A material of the base layer 1242 may be the same as or different from that of the thin film conductor layer. That is, the material of the base layer 1242 may be suitably selected by those skilled in the art as long as it has excellent electrical conductivity.

An upper surface of the base layer 1242 may be a surface of which etching treatment is completed. That is, for convenience of the process, after plating for the base layer is performed at a thickness thicker than a thickness to be required, an upper portion of a plating layer for the base layer may be etched so that a short-circuit between adjacent coil patterns may be prevented. However, when at the time of plating the base layer 1242, the plating is performed by those skilled in the art at a thickness at which the short-circuit between adjacent plating layers does not occur, there is no need to perform a separate etching treatment.

The base layer 1242 may substantially serve as a seed layer for a plating layer 1243 disposed thereon.

Meanwhile, the via hole v in the support member of the coil component may be filled with the thin film conductor layer and the base layer. The thin film conductor layer may be disposed in the vicinity of the via hole to be connected up to an entire inner side surface of the via hole, and the upper and lower surfaces of the support member connected to the via hole. The base layer may fill a region of the via hole including a central portion of the via hole, that is not filled with the thin film conductor layer. Reliability of a via may be improved by structures of the thin film conductor layer and the base layer filled in the via hole. In some cases, after generally filling a Cu material in a via hole, a separate coating layer may be disposed on upper and lower surfaces of the via hole. However, in this case, delamination between the via and the coating layer connected thereto may occur. However, since in the coil component 100, only one kind of base layer is formed up to a region penetrating through the via hole and upper and lower regions extended therefrom, there is no risk that a problem such as the above-mentioned delamination, or the like, will occur.

Next, the plating layer 1243 may be disposed on the base layer 1242, and an aspect ratio of the coil pattern may be substantially determined by an aspect ratio of the plating layer. Since the plating layer 1243 is filled in the opening pattern of the second insulating layers, and grows using the second insulating layer as a guide, when the plating layer 1243 grows in the thickness direction, growth of the plating layer 1243 in the width direction may be effectively controlled, such that the aspect ratio of the coil pattern may be stably increased.

The plating layer may grow up to a position equal to or lower than an upper surface of the second insulating layer. The reason is that when an upper surface of the plating layer is higher than the upper surface of the second insulating layer, a risk that a short-circuit between adjacent coil patterns will occur may be increased.

A third insulating layer 125 may be further disposed on the upper surface of the plating layer in order to insulate the coil pattern and an encapsulant encapsulating the coil pattern from each other. A thickness of the third insulating layer is not limited as long as the third insulating layer may perform the insulation function as described above, but the thickness of the third insulating layer may be about 1 μm or more to 30 μm or less. When the third insulating layer has a nano-scaled thickness thinner than 1 μm, a risk that the third insulating layer will be damaged in use or during a manufacturing process may be significantly increased, and there is a limitation in controlling uniformity of the thickness. On the contrary, the thickness of the third insulating layer is thicker than 30 μm, which is disadvantageous in view of a high aspect ratio of the coil pattern and a high filling rate the magnetic material in a low-profile coil component.

Referring to FIG. 2, the third insulating layer 125 may have a shape of a laminated insulating sheet. The third insulating layer may be formed of an insulating resin or a magnetic resin having insulation properties, and since the third insulating layer is a configuration for insulation between the coil pattern and the magnetic material, a suitable thickness of the third insulating layer may be set by those skilled in the art as needed. Both end portions of the third insulating layer may be positioned on the same line as an innermost side surface of the second insulating layer and an outermost side surface of the second insulating layer, but if necessary, at least one of both end portions of the third insulating layer may be formed to further protrude than the innermost or outermost side surface of the second insulating layer.

Figure 3:
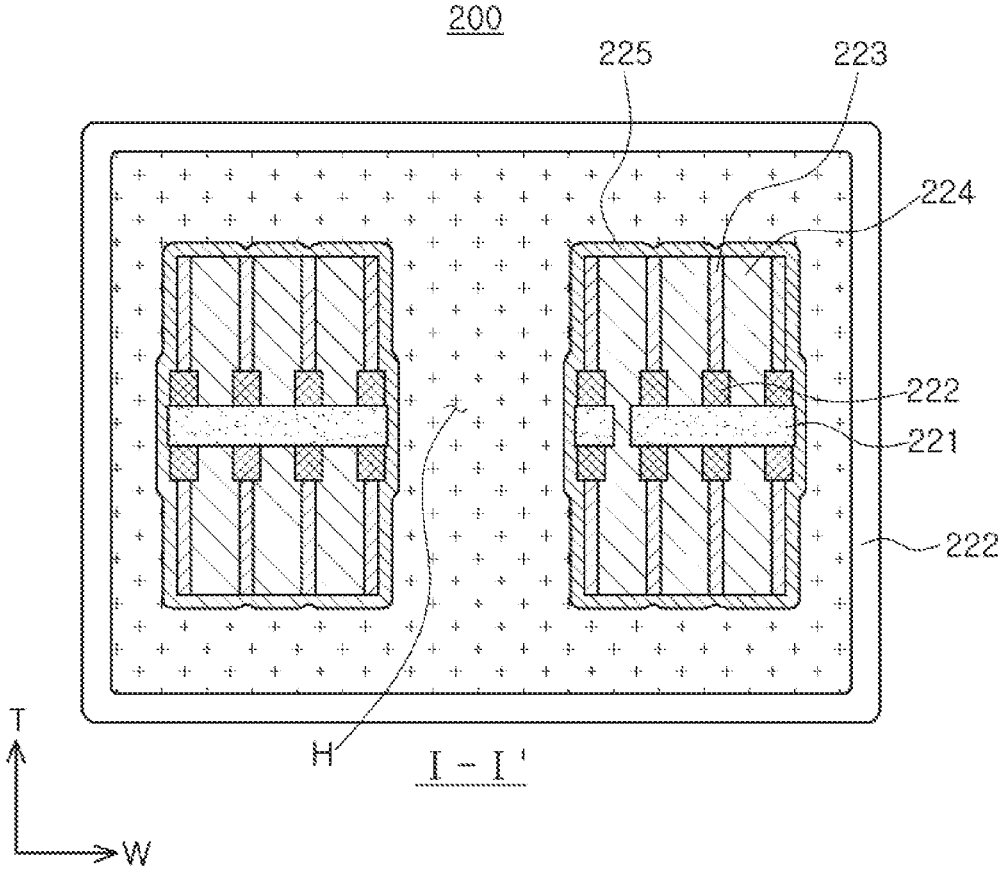
FIG. 3 is a cross sectional view of a coil component according to a modified example of the coil component illustrated in FIGS. 1 and 2.

FIG. 3 is a cross sectional view of a coil component 200 according to a modified example of the coil component illustrated in FIGS. 1 and 2. Since the coil component 200 of FIG. 3 is different from the coil component 100 of FIGS. 1 and 2 in view of a structure of a third insulating layer, the structure of the third insulating layer will be mainly described, and a technical description of overlapping configurations will be omitted.

Referring to FIG. 3, a third insulating layer 225 of the coil component 200 may be formed to enclose an outer side surface of an outermost second insulating layer as well as an upper surface of a coil pattern and an upper surface of a second insulating layer. This is to further strengthen insulation properties of the coil component, and a specific method of forming the third insulating layer 225 is not limited, but the third insulating layer 225 may be formed by chemical vapor deposition (CVD) of an insulating resin.

In addition, although not specifically illustrated, in order to increase a filling rate of a magnetic material in the center of a magnetic core, the third insulating layer may be formed to come in contact with an inner side surface of an innermost coil pattern without interposition of the second insulating layer after removing an innermost second insulating layer. In this case, a method of removing the innermost second insulating layer is not particularly limited, but simultaneously with formation of a through-hole of a support member, the innermost second insulating layer adjacent to the through-hole may be removed.

A specific thickness of the third insulating layer may be suitably selected by those skilled in the art. However, when the thickness is thinner than 1 μm, it may be difficult to control a nano-scaled insulating layer to be uniform in a process, and when the thickness is thicker than 10 μm, a space in which the magnetic material may be filled may be decreased. Therefore, the thickness of the third insulating layer may be within a range from about 1 μm or more to about 10 μm or less.

As set forth above, according to exemplary embodiments in the present disclosure, the low-profile coil component including the coil pattern having a high aspect ratio may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a support member including a through-hole, a first insulating layer disposed on the support member and including a first opening pattern, a second insulating layer disposed on the first insulating layer and including a second opening pattern, and a coil including a coil pattern filled in the first and second opening patterns; and external electrodes disposed on an outer surface of the body, wherein the coil pattern has a T-shaped cross section of which a line width of a lower surface is narrower than that of an upper surface opposing the lower surface and has a stacking structure composed of a plurality of layers, the plurality of layers includes a thin film conductor layer in contact with the support member, the thin film conductor layer extending to an entire lower surface of the first opening pattern and at least portions of side surfaces of the first opening pattern, a boundary is defined between the first insulating layer and the second insulating layer, and the plurality of layers further includes a seed layer.

2. The coil component of claim 1, wherein the seed layer contains a conductive material and is disposed on the thin film conductor layer.

3. The coil component of claim 2, wherein the seed layer is embedded in the first opening pattern of the first insulating layer.

4. The coil component of claim 1, wherein the support member further includes a via hole.

5. The coil component of claim 4, wherein side surfaces of the via hole are entirely enclosed by the thin film conductor layer.

6. The coil component of claim 5, wherein the thin film conductor layer extends to portions of upper and lower surfaces of the support member connected to the via hole.

7. The coil component of claim 1, wherein a thickness of the support member is within a range from 10 μm to less than 60 μm.

8. The coil component of claim 1, wherein a thickness of the first insulating layer is within a range from 5 μm to 20 μm.

9. The coil component of claim 1, wherein a thickness of the second insulating layer is within a range from 100 μm to 300 μm.

10. The coil component of claim 1, wherein a line width of the first insulating layer is within a range from 15 μm to 100 μm, and a line width of the second insulating layer is within a range from 5 μm to 20 μm.

11. The coil component of claim 1, wherein the body contains a magnetic material, and the magnetic material encapsulates the coil.

12. The coil component of claim 11, wherein the through-hole of the support member includes the magnetic material.

13. The coil component of claim 1, further comprising a third insulating layer disposed on the upper surface of the coil pattern.

14. The coil component of claim 13, wherein the third insulating layer covers an entirety of the upper surface of the coil pattern.

15. The coil component of claim 13, wherein the third insulating layer has a flat shape.

16. The coil component of claim 13, wherein the third insulating layer encloses the upper surface of the coil pattern, an upper surface of the second insulating layer, and at least a portion of one surface of the support member.

17. The coil component of claim 16, wherein a thickness of the third insulating layer is within a range from 1 μm to 10 μm.

18. The coil component of claim 1, wherein the thin film conductor layer is a plated layer.

19. A coil component comprising:

a body including a support member including a through-hole, a first insulating layer disposed on the support member and including a first opening pattern, a second insulating layer disposed on the first insulating layer and including a second opening pattern, and a coil including a coil pattern filled in the first and second opening patterns; and external electrodes disposed on an outer surface of the body, wherein the coil pattern has a T-shaped cross section of which a line width of a lower surface is narrower than that of an upper surface opposing the lower surface and has a stacking structure composed of a plurality of layers, the plurality of layers includes a thin film conductor layer in contact with the support member, the thin film conductor layer extending to an entire lower surface of the first opening pattern and at least portions of side surfaces of the first opening pattern, the plurality of layers further includes a seed layer disposed on the thin film conductor layer and a plating layer disposed on the seed layer, and the seed layer has a line width smaller than a line width of the plating layer.

20. A coil component comprising:

a body including a support member including a through-hole, a first insulating layer disposed on the support member and including a first opening pattern, a second insulating layer disposed on the first insulating layer and including a second opening pattern, and a coil including a coil pattern filled in the first and second opening patterns; and external electrodes disposed on an outer surface of the body, wherein the coil pattern has a T-shaped cross section of which a line width of a lower surface is narrower than that of an upper surface opposing the lower surface and has a stacking structure composed of a plurality of layers, the plurality of layers includes a thin film conductor layer in contact with the support member, the thin film conductor layer extending to an entire lower surface of the first opening pattern and at least portions of side surfaces of the first opening pattern, and the plurality of layers further includes a seed layer disposed on the thin film conductor layer and in contact with an inner side surface of the thin film conductor layer.

* * * * *